US006758728B2

(12) United States Patent
Inoue et al.

(10) Patent No.: US 6,758,728 B2
(45) Date of Patent: Jul. 6, 2004

(54) METHOD AND APPARATUS FOR CLEANING POLISHING SURFACE OF POLISHER

(75) Inventors: Tatsuo Inoue, Kanagawa-ken (JP); Mitsunori Komatsu, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/196,411

(22) Filed: Jul. 17, 2002

(65) Prior Publication Data

US 2002/0197944 A1 Dec. 26, 2002

Related U.S. Application Data

(62) Division of application No. 09/790,976, filed on Feb. 23, 2001, now Pat. No. 6,443,816.

(30) Foreign Application Priority Data

Feb. 24, 2000 (JP) ..... 2000-47694

(51) Int. Cl.[7] ..... B24B 1/00
(52) U.S. Cl. ..... 451/56; 451/444
(58) Field of Search ..... 451/56, 443, 444, 451/446, 60, 72

(56) References Cited

U.S. PATENT DOCUMENTS 5,716,264 A 2/1998 Kimura et al.
5,779,522 A * 7/1998 Walker et al. ..... 451/56
5,846,336 A 12/1998 Skrovan
5,857,898 A * 1/1999 Hiyama et al. ..... 451/56
5,934,566 A 8/1999 Kanno et al.
6,007,406 A 12/1999 Custer et al.
6,012,968 A * 1/2000 Lofaro ..... 451/39
6,053,801 A * 4/2000 Pinson et al. ..... 451/56
6,227,947 B1 5/2001 Hu et al.
6,350,183 B2 2/2002 Manfredi

FOREIGN PATENT DOCUMENTS

| | | |
|---|---|---|
| DE | 19737854 A1 | 3/1999 |
| EP | 0887153 A2 | 12/1998 |
| JP | 10-202502 | 8/1998 |
| JP | 11-10524 | 1/1999 |
| JP | 2000-354948 | 12/2000 |
| WO | 99/11433 | 3/1999 |

* cited by examiner

*Primary Examiner*—Dung Van Nguyen
(74) *Attorney, Agent, or Firm*—Wenderoth, Lind & Ponack, L.L.P.

(57) ABSTRACT

A polishing surface cleaning method and apparatus are capable of effectively removing the polishing residue from the polishing surface of a polishing table in a polisher by using a minimal amount of cleaning liquid. In the polisher, a workpiece to be polished is pressed against the polishing surface of the polishing table to polish the workpiece by relative motion between the polishing surface and the workpiece. The polishing surface cleaning apparatus uses mixing spray nozzles for mixing together a cleaning liquid and a gas and spraying the resulting fluid mixture on the polishing surface to clean it.

3 Claims, 5 Drawing Sheets

METHOD AND APPARATUS FOR CLEANING POLISHING SURFACE OF POLISHER

This is a Divisional Application of prior U.S. patent application Ser. No. 09/790,976, filed Feb. 23, 2001 now U.S. Pat. No. 6,443,816.

BACKGROUND OF THE INVENTION

The present invention relates to a method and apparatus for cleaning a polishing surface of a polisher in which a workpiece to be polished, e.g. a semiconductor wafer, is pressed against the polishing surface of a polishing cloth, a polishing abrasive wheel, etc. on a polishing table to polish the workpiece by relative motion between the polishing surface and the workpiece.

Conventionally, this type of polisher involves the problem that the residue of a polished workpiece, e.g. a semiconductor wafer, remaining on the polishing surface of the polishing cloth may damage a workpiece in the subsequent polishing process. To solve the problem, when the polishing surface of the polishing cloth is subjected to dressing by a dresser (regenerating device), a cleaning liquid, e.g. pure water, or nitrogen gas is sprayed on the polishing surface, whereby the residue of the polished workpiece on the polishing surface is discharged to the outside of the system.

When pure water is sprayed on the polishing surface as a cleaning liquid, the amount of pure water used in the entire system increases, and the amount of pure water to be supplied to a polishing unit becomes insufficient. Furthermore, pure water as sprayed on the polishing surface of the polishing cloth under low pressure cannot assist in scraping the polishing residue from the recesses in the polishing cloth surface. Consequently, it is necessary to perform dressing under a sufficiently heavy load. However, if the polishing cloth is dressed under an increased load, the stock removal of the polishing cloth by dressing increases. Thus, the polishing cloth wears out at an increased rate.

If pure water is sprayed under high pressure in order to enhance the polishing residue scraping effect, the amount of pure water used further increases, as a matter of course, causing the pure water supply to become insufficient.

Meanwhile, the method wherein nitrogen gas is sprayed on the polishing surface to blow away the polishing residue to the outside of the system is effective but has the disadvantage that the polishing residue may be dried by being sprayed with the nitrogen gas to become fixed even more firmly on the polishing cloth surface. Moreover, the spraying of nitrogen gas causes the polishing residue to scatter and contaminate the outside of the system, i.e. the surroundings of the polishing table. This exerts adverse effects upon the subsequent polishing process.

The present invention was made in view of the above-described circumstances. Accordingly, an object of the present invention is to provide a polishing surface cleaning method capable of effectively removing the polishing residue from the polishing surface of the polishing table by using a minimal amount of cleaning liquid.

Another object of the present invention is to provide a polishing surface cleaning apparatus suitably used to carry out the polishing surface cleaning method.

The present invention provides a polishing surface cleaning method for use in a polisher in which a workpiece to be polished is pressed against a polishing surface of a polishing table to polish the workpiece by relative motion between the polishing surface and the workpiece. According to the polishing surface cleaning method, a fluid mixture of a cleaning liquid and a gas is sprayed on the polishing surface to clean it.

By spraying a fluid mixture of a cleaning liquid and a gas on the polishing surface, the polishing residue on the polishing surface is scraped off by the gas in the fluid mixture and further washed away by the cleaning liquid. Therefore, the polishing residue on the polishing surface is removed almost completely. Accordingly, the polishing surface cleaned by this method is unlikely to damage a workpiece in the subsequent polishing process and can maintain stable polishing performance.

The fluid mixture may be sprayed on the polishing surface from a plurality of mixing spray nozzles provided above the polishing surface of the polishing table. The mixing spray nozzles are arranged to mix together a cleaning liquid and a gas and to spray the resulting fluid mixture.

In addition, the present invention provides a polishing surface cleaning apparatus for use in a polisher in which a workpiece to be polished is pressed against a polishing surface of a polishing table to polish the workpiece by relative motion between the polishing surface and the workpiece. The apparatus includes a mixing spray nozzle for mixing together a cleaning liquid and a gas and for spraying the resulting fluid mixture on the polishing surface to clean it.

By spraying a fluid mixture of a cleaning liquid and a gas on the polishing surface from the mixing spray nozzle, the polishing residue on the polishing surface is removed almost completely. Accordingly, the polishing surface cleaned by this apparatus is unlikely to damage a workpiece in the subsequent polishing process and can maintain stable polishing performance.

The polishing surface cleaning apparatus may further include a pressure controller for independently controlling the respective pressures of a cleaning liquid and a gas supplied to the mixing spray nozzle.

The provision of the pressure controller allows desired control of the ratio between the cleaning liquid and the gas in the fluid mixture and the spray speed of the fluid mixture and enables the cleaning action on the polishing surface and so forth to be controlled as desired.

In the polishing surface cleaning apparatus, the mixing spray nozzle may be secured to a mounting member for mounting an abrasive liquid supply nozzle for supplying an abrasive liquid to the polishing surface or a chemical liquid supply nozzle for supplying a chemical liquid to the polishing surface.

The foregoing and other objects, features and advantages of the present invention will be apparent from the following detailed description and appended claims taken in connection with the accompanying drawings.

BRIEF DESCRIPTION OF THE DRAWINGS

FIG. 4 is a diagram showing the locus of a spray of fluid mixture from a mixing spray nozzle, of which.

DETAILED DESCRIPTION OF THE INVENTION

Embodiments of the present invention will be described below in detail with reference to the accompanying drawings.

Figure 1:
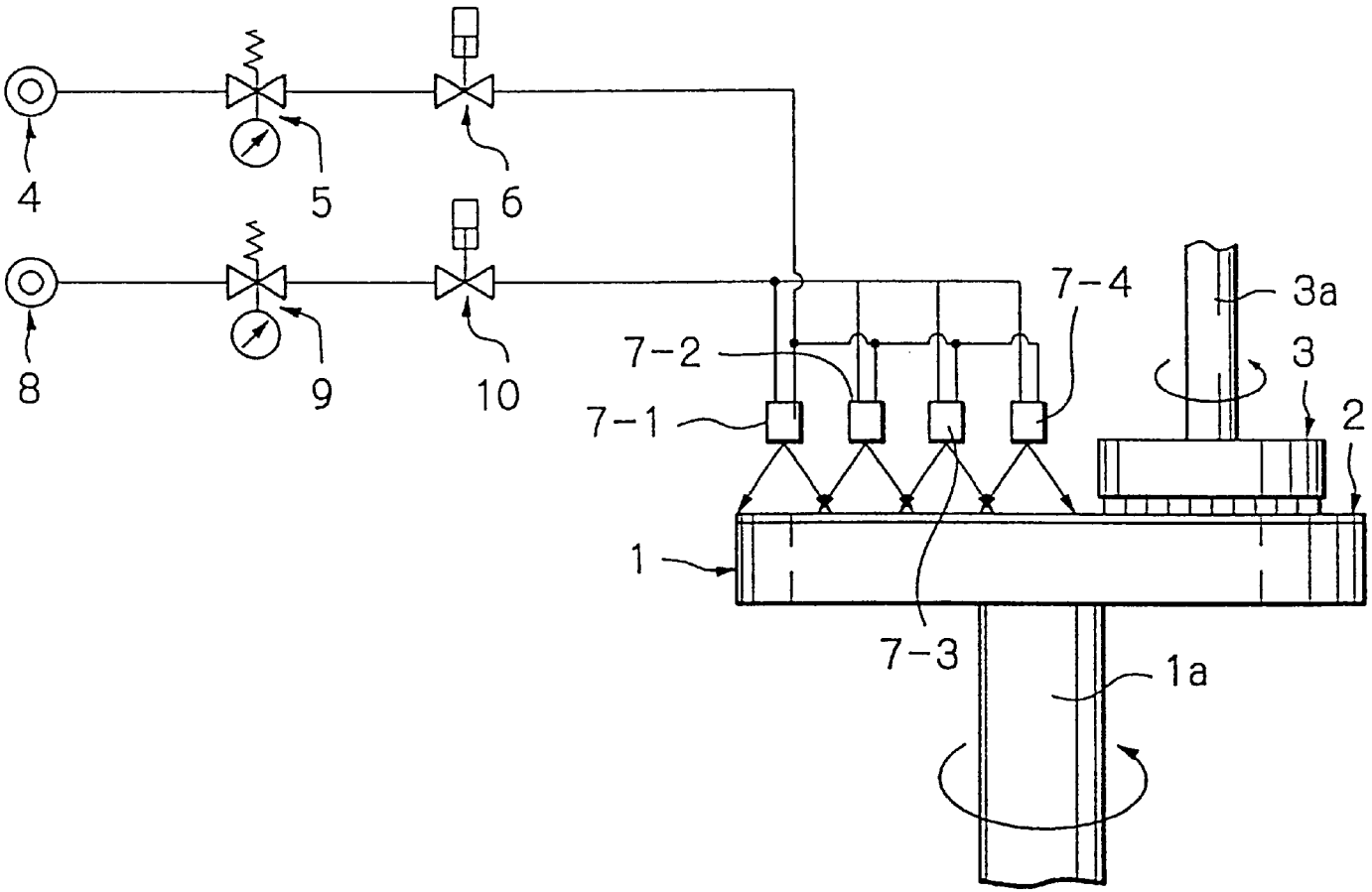
FIG. 1 is a diagram schematically showing a structural example of a polisher in which the polishing surface cleaning method according to the present invention is carried out.

FIG. 1 is a schematic view showing a structural example of a polisher in which the polishing surface cleaning method according to the present invention is carried out. In this polisher, pure water is used as a cleaning liquid, and nitrogen gas is used as a gas mixed with the cleaning liquid, by way of example. However, the cleaning liquid used in this embodiment is not necessarily limited to pure water but may, for example, be an abrasive liquid used for polishing or a chemical liquid for cleaning. The gas mixed with the cleaning liquid is not necessarily limited to nitrogen gas but maybe, for example, compressed air or steam having oil mist with particles removed therefrom through a filter member (not shown).

In FIG. 1, a polishing table 1 has a polishing cloth 2 bonded to the top thereof. A dresser 3 regenerates the polishing surface of the polishing cloth 2. The polishing table 1 rotates about a rotating shaft 1*a*. The dresser 3 rotates about a rotating shaft 3*a*. When the polishing surface of the polishing cloth 2 is to be regenerated, the dresser 3 is pressed against the polishing surface of the polishing cloth 2 with a predetermined pressure, and the polishing surface is regenerated (dressed) by relative motion between the polishing cloth 2 and the dresser 3.

A plurality (four in the illustrated example) of mixing spray nozzles 7-1 to 7-4 are disposed above the polishing table 1. The mixing spray nozzles 7-1 to 7-4 mix together pure water and nitrogen gas and spray the resulting fluid mixture on the polishing surface of the polishing cloth 2. The mixing spray nozzles 7-1 to 7-4 are supplied with nitrogen gas from a nitrogen gas supply source 4 through an air-operated valve 6 after the pressure thereof has been adjusted through a regulator 5. The mixing spray nozzles 7-1 to 7-4 are also supplied with pure water from a pure water supply source 8 through an air-operated valve 10 after the pressure thereof has been adjusted through a regulator 9. In each spray nozzle, the supplied liquid is formed into fine particles or solidified into fine particles or evaporated (i.e. the liquid is atomized) by changing various parameters such as the pressure of the liquid and/or the gas, temperature, and nozzle configuration, and a mixture of liquid and gas components is sprayed from the nozzle toward the polishing table 1 with a predetermined directional property. Accordingly, the fluid mixture may include particles which are formed by solidification from the same liquid that is supplied. Further, the fluid mixture may include a gas and a liquid, where the gas is formed by evaporation from the same liquid that is supplied.

When the polishing surface is regenerated (dressed) by relative motion between the polishing cloth 2 and the dresser 3, the fluid mixture of pure water and nitrogen gas is sprayed on the surface (polishing surface) of the polishing cloth 2 from the mixing spray nozzles 7-1 to 7-4 to clean the polishing surface. The pressure of nitrogen gas can be set in the range of from 0.01 MPa (megapascal) to 0.7 MPa. The pressure of pure water can be set in the range of from 0.1 MPa to 0.3 MPa. The pressure of nitrogen gas and that of pure water can be set independently of each other. Although in this embodiment both the pure water line and the nitrogen line use manually-driven regulators, each line may use a regulator capable of changing the set pressure on the basis of an external signal. In the case of using regulators driven on the basis of external signals, the pressures of pure water and nitrogen gas can be changed for each polishing process according to signals from a controller (not shown).

When pure water is supplied by using booster equipment, the pressure of pure water can readily be raised up to 1.0 MPa. However, boosting the pressure in excess of this level is not always effective because it would be necessary to use special equipment in order to increase the pressure resistance of the supply system. In this embodiment, the pressure of nitrogen gas is set at 0.35 MPa, and the pressure of pure water at 0.1 MPa.

Figure 2:
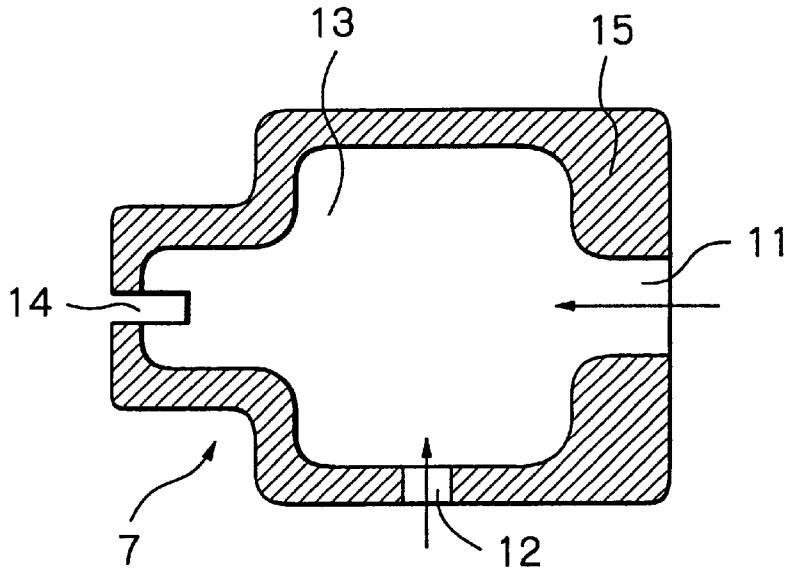
FIG. 2 is a diagram showing the structure of an example of a mixing spray nozzle used in the polishing surface cleaning method according to the present invention.

The structures of mixing spray nozzles 7 will be described below with reference to FIGS. 2 and 3. The mixing spray nozzle 7 shown in FIG. 2 has a nozzle body 15 provided therein with a mixing part 13, which is a space for mixing together a liquid and a gas. The nozzle body 15 is provided with a liquid supply opening 12, a gas supply opening 11, and a fluid mixture discharge opening 14. Nitrogen gas is supplied to the gas supply opening 11 at a predetermined pressure (0.35 MPa in this embodiment), and pure water is supplied to the liquid supply opening 12 at a predetermined pressure (0.1 MPa in this embodiment). Consequently, the nitrogen gas and the pure water are mixed together in the mixing part 13, and the resulting fluid mixture is sprayed from the fluid mixture discharge opening 14 with the total pressure of the nitrogen gas and the pure water. The angle at which the fluid mixture is sprayed from the mixing spray nozzle 7 is determined by the configuration of the fluid mixture discharge opening 14.

Figure 3:
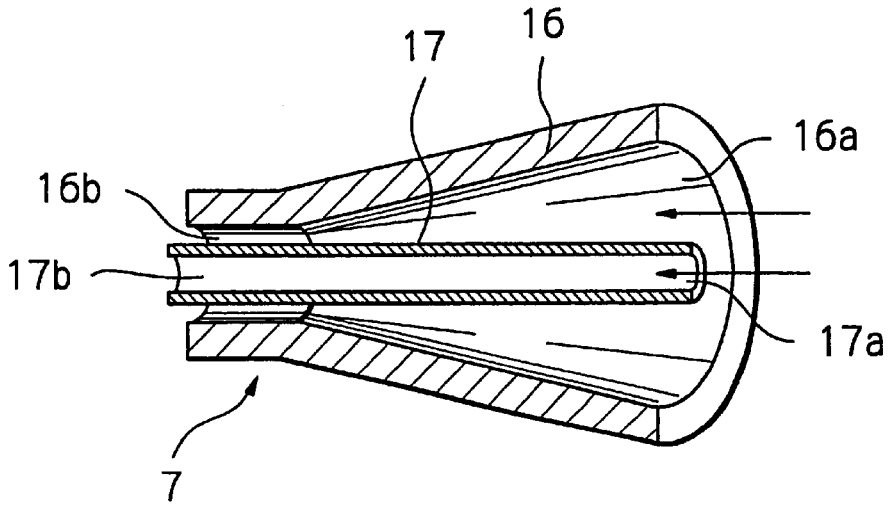
FIG. 3 is a diagram showing the structure of another example of a mixing spray nozzle used in the polishing surface cleaning method according to the present invention.

The mixing spray nozzle 7 shown in FIG. 3 has a conical nozzle body 16 in which a liquid supply pipe 17 is disposed. A gas supply opening 16*a* is provided at one end (rear end) of the nozzle body 16, and a gas discharge opening 16*b* is provided at the other end (forward end) of the nozzle body 16. A liquid supply opening 17*a* is provided at one end (rear end) of the liquid supply pipe 17, and a liquid discharge opening 17*b* is provided at the other end (forward end) of the liquid supply pipe 17. Nitrogen gas is supplied to the gas supply opening 16*a* at a predetermined pressure (0.35 MPa in this embodiment), and pure water is supplied to the liquid supply opening 17*a* at a predetermined pressure (0.1 MPa in this embodiment). Consequently, the pure water discharged from the liquid discharge opening 17*b* is caught in the nitrogen gas from the gas discharge opening 16*b* and shot out as a spray with the pressure of the nitrogen gas. The angle at which the fluid mixture is sprayed from the mixing spray nozzle 7 is determined by the configuration of the gas discharge opening 16*b*.

Figure 4A:
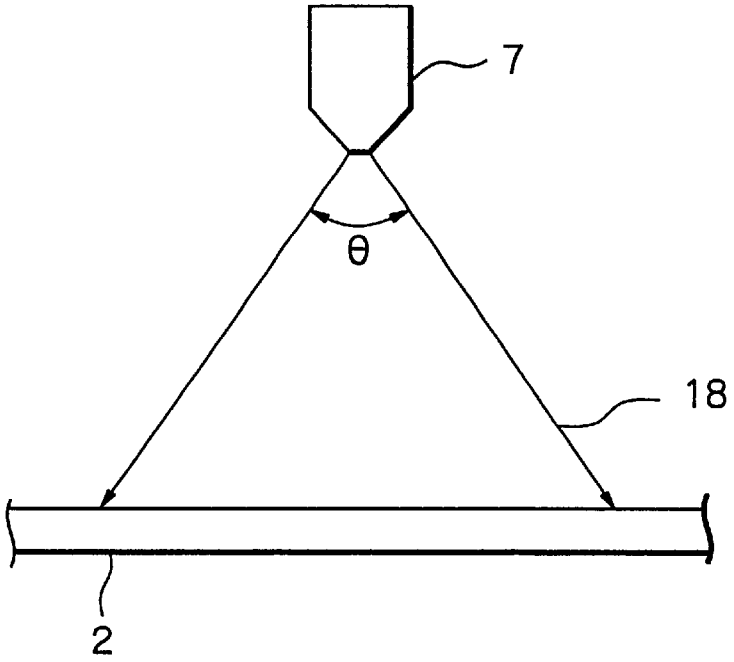
FIG. 4*a* is a side view showing the configuration of the spray of fluid mixture as seen from a side thereof.
Figure 4B:
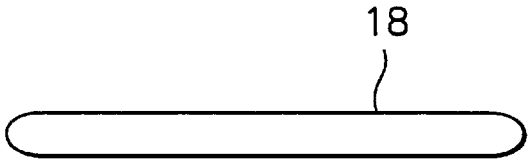
FIG. 4*b* is a plan view showing the configuration of the spray of fluid mixture on the polishing cloth surface as seen from above.
Figure 4C:
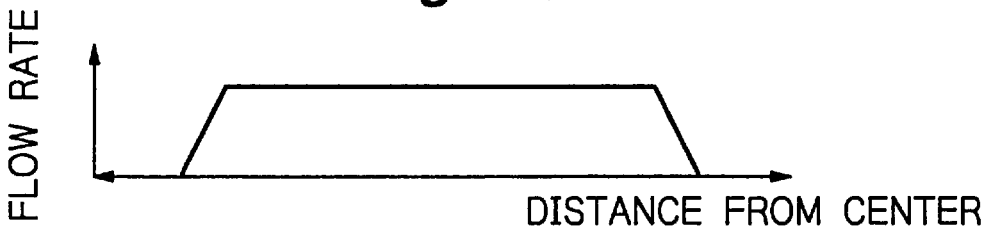
FIG. 4*c* is a graph showing the flow distribution of the fluid mixture.

FIG. 4 is a diagram showing the locus of a spray of fluid mixture from a mixing spray nozzle 7. FIG. 4*a* is a side view showing the configuration of the spray of fluid mixture as seen from a side thereof. FIG. 4*b* is a plan view showing the configuration of the spray of fluid mixture on the polishing cloth surface as seen from above. FIG. 4*c* is a graph showing the flow distribution of the fluid mixture. A spray of fluid mixture 18 from the mixing spray nozzle 7 spreads at the spray angle θ and impinges on the top surface of the polishing cloth 2. Because the fluid mixture 18 needs to be sprayed on the whole surface of the rotating polishing cloth 2, it is preferable that the spray angle θ be widened, and a plurality of mixing spray nozzles 7 having a spray angle of 45° to 75° should be used (a total of four mixing spray nozzles 7-1 to 7-4 are used in FIG. 1).

On the surface of the polishing cloth 2, the fluid mixture 18 assumes an oval shape as shown in FIG. 4*b*. The flow distribution of the fluid mixture 18 on the surface of the polishing cloth 2 is approximately uniform at the central portion, exclusive of both ends (i.e. a trapezoidal flow distribution), as shown in FIG. 4*c*.

Figure 5:
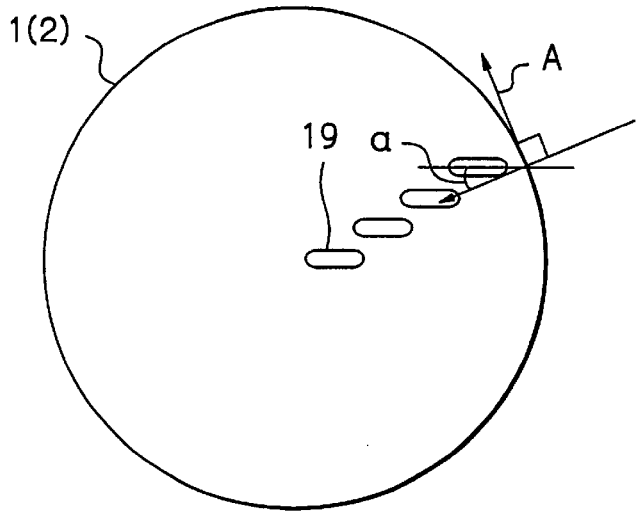
FIG. 5 is a diagram showing spots where sprays of fluid mixture from mixing spray nozzles impinge on the polishing cloth surface.

FIG. 5 is a diagram showing spots where sprays of fluid mixture 18 impinge on the surface of the polishing cloth 2. The locus 19 of a spray of fluid mixture 18 impinging on the surface of the polishing cloth can 2 can be regarded as having an angle α with respect to a direction perpendicular to the rotational direction A of the polishing table 1. A suitable angle α is 45° with respect to a direction perpendicular to the rotational direction A of the polishing table 1. Further, the mixing spray nozzles 7-1 to 7-4 are arranged so that the end portions of each pair of adjacent sprays of fluid mixture 18 overlap each other as seen from the side. With this arrangement, the fluid mixture 18 can be sprayed on the surface of the polishing cloth 2 with a uniform flow distribution.

Figure 6:
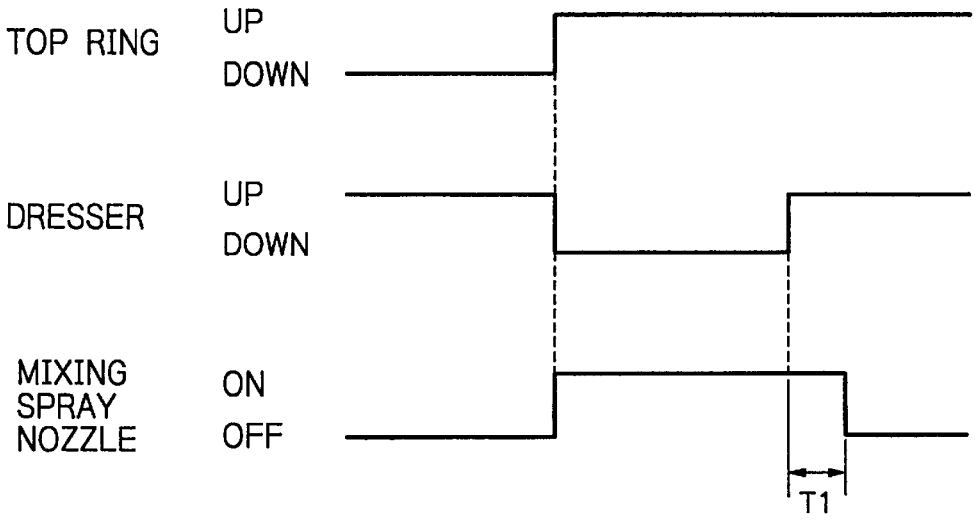
FIG. 6 is a timing chart showing an example of the timing at which the fluid mixture is sprayed in the polisher in which the polishing surface cleaning method according to the present invention is carried out.

The timing at which the fluid mixture 18 is sprayed will be described below with reference to FIG. 6. The fluid mixture 18 is sprayed after the completion of polishing of a workpiece, e.g. a semiconductor wafer (i.e. after the top ring has been lifted). More specifically, at the same time as the dresser 3 lands on the surface of the polishing cloth 2 to begin dressing, the mixing spray nozzle 7 is turned on to spray the fluid mixture 18. It is preferable that the spraying of the fluid mixture 18 should not be stopped immediately after the completion of dressing (i.e. immediately after the dresser 3 has been lifted), but cleaning with the fluid mixture 18 should be performed satisfactorily. If the period of time for cleaning (T1) with the fluid mixture 18 after the completion of dressing is long, the time spent on the polishing process lengthens. Therefore, the cleaning time T1 should preferably be restricted to be within 10 seconds. Waste liquid remaining on the polishing table 1 is centrifugally removed from the polishing surface by increasing the number of revolutions of the polishing table 1. Accordingly, no cleaning residue is left on the polishing surface.

Figure 7:
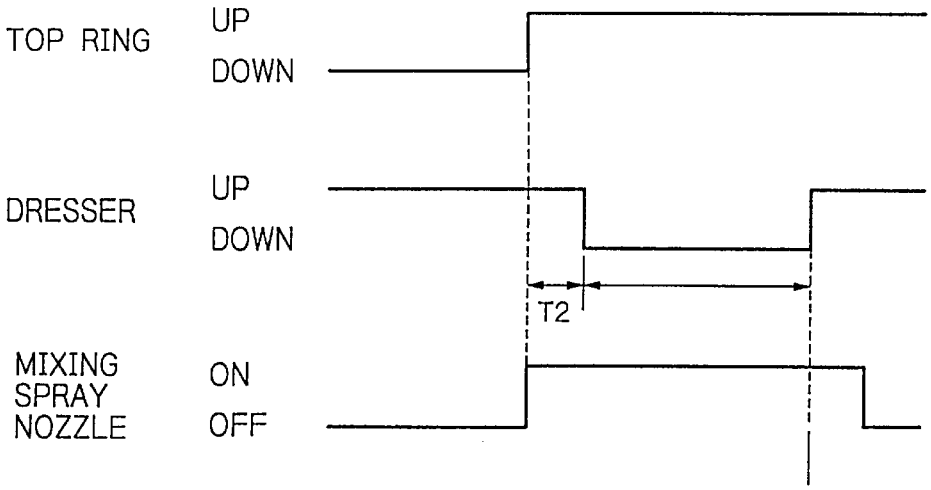
FIG. 7 is a timing chart showing another example of the timing at which the fluid mixture is sprayed in the polisher in which the polishing surface cleaning method according to the present invention is carried out.

The fluid mixture spray timing may also be such that, as shown in FIG. 7, after the completion of polishing (i.e. after the top ring has been lifted) and before dressing is started, the mixing spray nozzle 7 is turned on to begin spraying of the fluid mixture 18, and after a predetermined period of time T2 has elapsed, dressing is started (i.e. the dresser 3 is lowered). Thus, after the completion of polishing, the fluid mixture 18 is sprayed for a predetermined period of time T2 to remove the polishing slurry from the surface of the polishing cloth 2, and thereafter, dressing is performed. With this arrangement, the dresser 3 can be prevented from being corroded by the polishing slurry, and the lifetime of the dresser 3 can be increased. However, care must be taken that the set time T2 will not be excessively long, because spraying of the fluid mixture 18 before dressing also lengthens the time spent on the polishing process.

Figure 8:
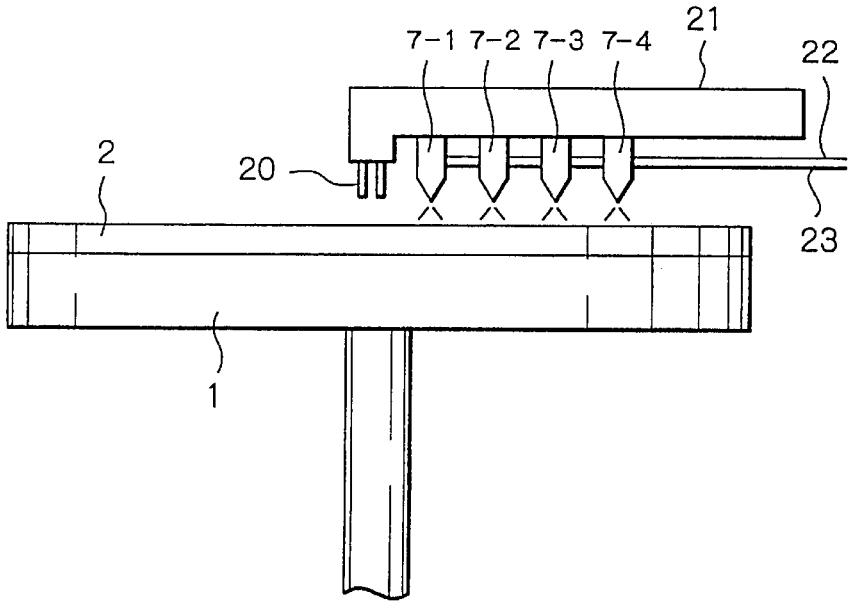
FIG. 8 is a diagram showing an example of the installation of mixing spray nozzles in the polisher in which the polishing surface cleaning method according to the present invention is carried out.

FIG. 8 is a diagram showing another example of the way in which mixing spray nozzles are installed. As illustrated in the figure, mixing spray nozzles 7-1 to 7-4 are secured to a mounting member 21 for mounting an abrasive liquid supply nozzle 20 for supplying an abrasive liquid to the surface of the polishing cloth 2 or a chemical liquid supply nozzle (not shown) for supplying a chemical liquid (rinsing liquid). With this arrangement, it is possible to shunt a gas supply line 22 and a liquid supply line 23 for supplying nitrogen gas and pure water to the mixing spray nozzles 7-1 to 7-4 at the same time as the abrasive liquid supply nozzle or the chemical liquid supply nozzle is shunted. After the completion of polishing (before the top ring is lifted), the mixing spray nozzles 7-1 to 7-4 are operated to begin spraying of the fluid mixture 18 so as to remove the abrasive material remaining on the polishing table 1, whereby it is possible to prevent over-polishing and to stabilize the polishing rate.

In the foregoing embodiments, the present invention has been described with regard to an example of cleaning a polishing surface of a polisher that is formed by a polishing cloth 2 bonded to the top of a polishing table 1. However, the present invention is not necessarily limited to the described embodiments but may also be applied to the process of cleaning an abrasive wheel surface of a polisher having an abrasive wheel secured to the top of a polishing table.

As has been stated above, the present invention provides the following advantages.

According to the present invention, a fluid mixture of a cleaning liquid and a gas is sprayed on the polishing surface, whereby the polishing residue on the polishing surface is scraped off by the gas in the fluid mixture and further washed away by the cleaning liquid. Therefore, the polishing residue on the polishing surface is removed almost completely. Accordingly, the polishing surface cleaned by this method is unlikely to damage a workpiece in the subsequent polishing process and can maintain stable polishing performance.

According to the polishing surface cleaning apparatus of the present invention, a fluid mixture of a cleaning liquid and a gas is sprayed on the polishing surface from a mixing spray nozzle, whereby the polishing residue on the polishing surface is scraped off by the gas in the fluid mixture and further washed away by the cleaning liquid. Therefore, the polishing residue on the polishing surface is removed almost completely. Accordingly, the polishing surface cleaned by this apparatus is unlikely to damage a workpiece in the subsequent polishing process and can maintain stable polishing performance.

If the polishing surface cleaning apparatus is provided with a pressure controller for independently controlling the respective pressures of a cleaning liquid and a gas supplied to the mixing spray nozzle, it is possible to effect a desired control of the ratio between the cleaning liquid and the gas in the fluid mixture and the spray speed of the fluid mixture and hence possible to control the cleaning action on the polishing surface as desired.

The mixing spray nozzle may be secured to a mounting member for mounting an abrasive liquid supply nozzle for supplying an abrasive liquid to the polishing surface or a chemical liquid supply nozzle for supplying a chemical liquid to the polishing surface. This arrangement makes it possible to shunt a gas supply line and a liquid supply line at the same time as the abrasive liquid supply nozzle or the chemical liquid supply nozzle is shunted.

It should be noted that the present invention is not limited to the foregoing embodiments but can be modified in a variety of ways.

What is claimed is:

1. A polishing surface cleaning method for use in a polisher in which a workpiece to be polished is pressed against a polishing surface of a polishing table to polish said workpiece by relative motion between said polishing surface and said workpiece, comprising spraying a fluid mixture on said polishing surface to clean said polishing surface, wherein the fluid mixture includes a gas and a liquid, and wherein the gas is formed by evaporation of the liquid.

2. A polishing surface cleaning method for use in a polisher in which a workpiece to be polished is held by a top ring and pressed against a polishing surface of a polishing table to polish the workpiece by relative motion between the polishing surface and said workpiece, comprising spraying a fluid mixture on the polishing surface to clean the polishing surface, wherein said spraying of the fluid mixture starts after polishing of the workpiece has finished and before the top ring is lifted from the polishing surface.

3. A polishing surface cleaning method for use in a polisher in which a workpiece to be polished is pressed against a polishing surface of a polishing table to polish the workpiece by relative motion between the polishing surface and the workpiece, comprising spraying a fluid mixture on the polishing surface to clean the polishing surface such that a liquid of the fluid mixture forms a gas by evaporation of the liquid.

* * * * *